United States Patent [19]

Noble

[11] Patent Number: 4,693,200

[45] Date of Patent: Sep. 15, 1987

[54] APPARATUS FOR ENCLOSING A BOAT HULL

[75] Inventor: Thomas D. Noble, Chapin, Ill.

[73] Assignee: Noble Boyd Enterpises, Beardstown, Ill.

[21] Appl. No.: 802,429

[22] Filed: Nov. 27, 1985

[51] Int. Cl.[4] ..... B63B 59/02

[52] U.S. Cl. ..... 114/47; 114/222; 405/68

[58] Field of Search ..... 114/312, 339, 330-333, 114/342, 121, 45-48, 263, 264, 266, 267, 124, 125, 230, 222, 54, 221 R; 405/60-69; 4/487

[56] References Cited

U.S. PATENT DOCUMENTS

| | | | |
|---|---|---|---|
| 632,919 | 9/1899 | Farley | 114/222 |
| 1,973,813 | 9/1934 | Kelley | 114/222 |
| 3,142,283 | 7/1964 | Fisher | 114/222 |
| 3,205,851 | 9/1965 | Wiswell, Jr. | 114/222 |
| 3,685,477 | 8/1972 | Wood | 114/222 |
| 3,708,983 | 1/1973 | Brown | 405/64 |
| 3,922,861 | 12/1975 | Grihanghe | 405/66 |
| 3,922,862 | 12/1975 | Vidilles | 405/68 |
| 4,104,884 | 9/1978 | Preus | 405/68 |
| 4,215,644 | 8/1980 | Jackson | 114/222 |
| 4,260,285 | 4/1981 | Kurihara | 405/68 |

*Primary Examiner*—Jeffrey V. Nase
*Assistant Examiner*—C. T. Bartz
*Attorney, Agent, or Firm*—Marshall, O'Toole, Gerstein, Murray & Bicknell

[57] ABSTRACT

Apparatus for protectively enclosing and/or treating the submerged portion of a body floating on a surface of water, such as a boat hull, to prevent or reduce the growth of marine organisms on the submerged portion. The apparatus is formed of a generally rectangular frame having a depending water impervious envelope attached thereto sufficiently large to enclose the submerged portion of the floating body. The frame is formed of hollow tubular front, side and rear members with the front member being filled with floatation material which maintains the front member floating at all times on the surface of the water. Pump means are associated with the frame, preferably mounted the rear tubular member, with the pump adapted to pump water into the side and rear tubular means to cause the rear member to be submerged and moved pivotally downwardly about the floating front member so that the floating body, such as a boat, can be moved across the submerged rear member into the area defined by the rectangular frame. The pump means is also adapted to replace the water in the frame with air to cause the submerged rear and side member to rise and enclose the floating body within the frame and envelope depending therefrom.

11 Claims, 4 Drawing Figures

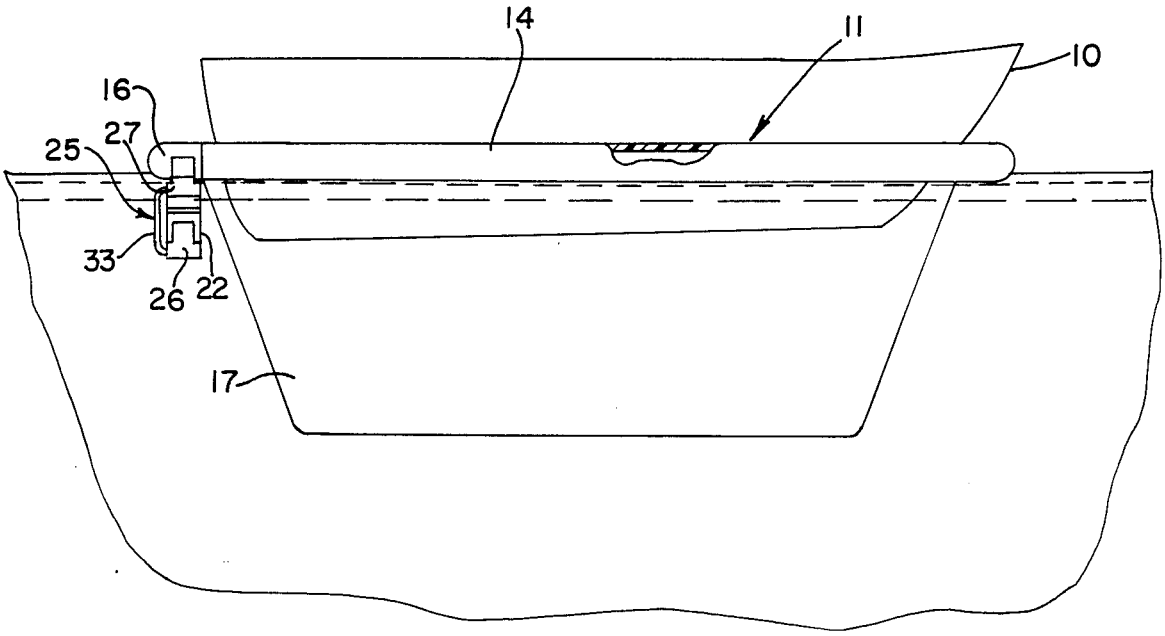
FIG. 1
FIG. 2
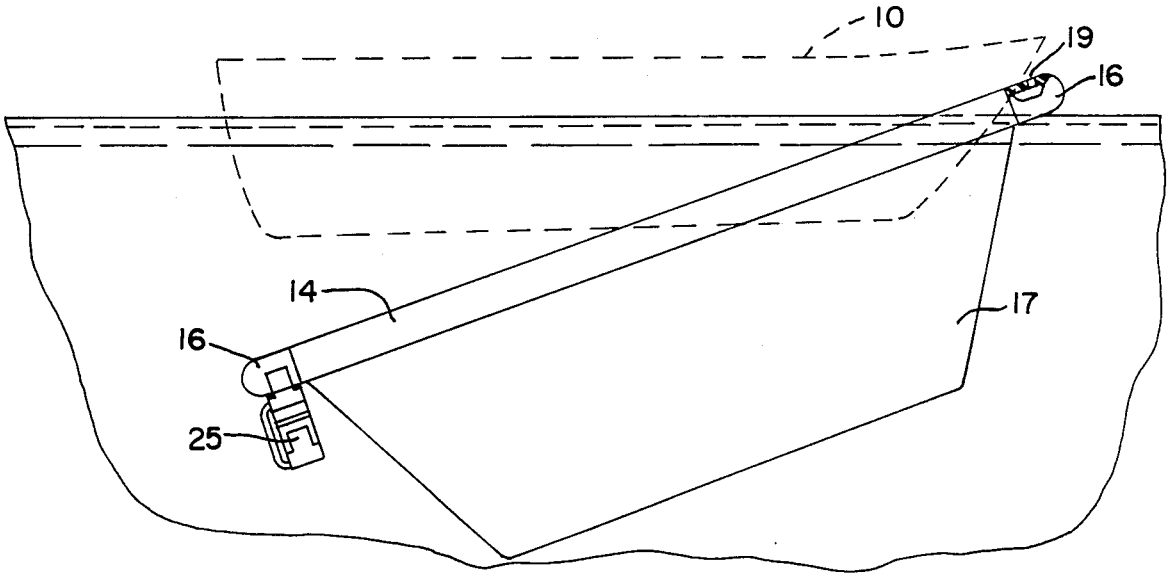

APPARATUS FOR ENCLOSING A BOAT HULL

The present invention relates generally to apparatus for enclosing and/or treating the submerged outer surface of a floatable body while the body is floating in water, and more particularly to apparatus for enclosing and/or treating the submerged body portion of a boat hull to prevent and/or remove the growth of marine organisms or plant life while the boat remains in a body of water.

Marine growth, such as algae, barnacles and the like, clearly reduces the efficiency of boats and can inflict damage to the hulls of certain boats. Many types of apparatus have been purposed for enclosing and/or treating the submerged surfaces of a boat hull for removing marine growth. Several of the apparatus have purposed employing envelopes which enclose the below-the-water-line hull of a boat while the boat remains in the water to form a barrier between the main body of water and the boat hull so that an anti-fouling chemically can be added to the water confined within the envelope. Patents which relate to such apparatus include U.S. Pat. Nos. 4,215,644, 3,685,477, 3,205,851; 3,142,283: 1,973,813; and 632,919. Several of these structures are expensive to construct and the others are difficult and/or time consuming to manipulate in order to enclose a boat hull.

It is therefore object of the present invention to provide an improved apparatus for enclosing and/or treating boat hull while the boat remains afloat.

It is a further object of the present invention to provide an apparatus for enclosing and/or treating a boat hull which is inexpensive to construct and simple to operate.

Figure 3:
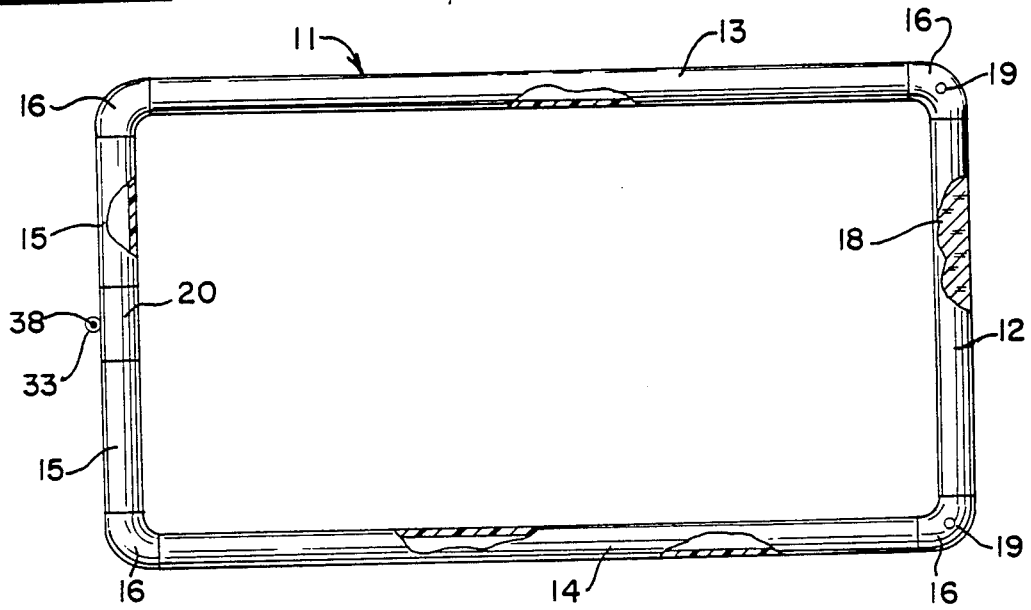
Figure 4:
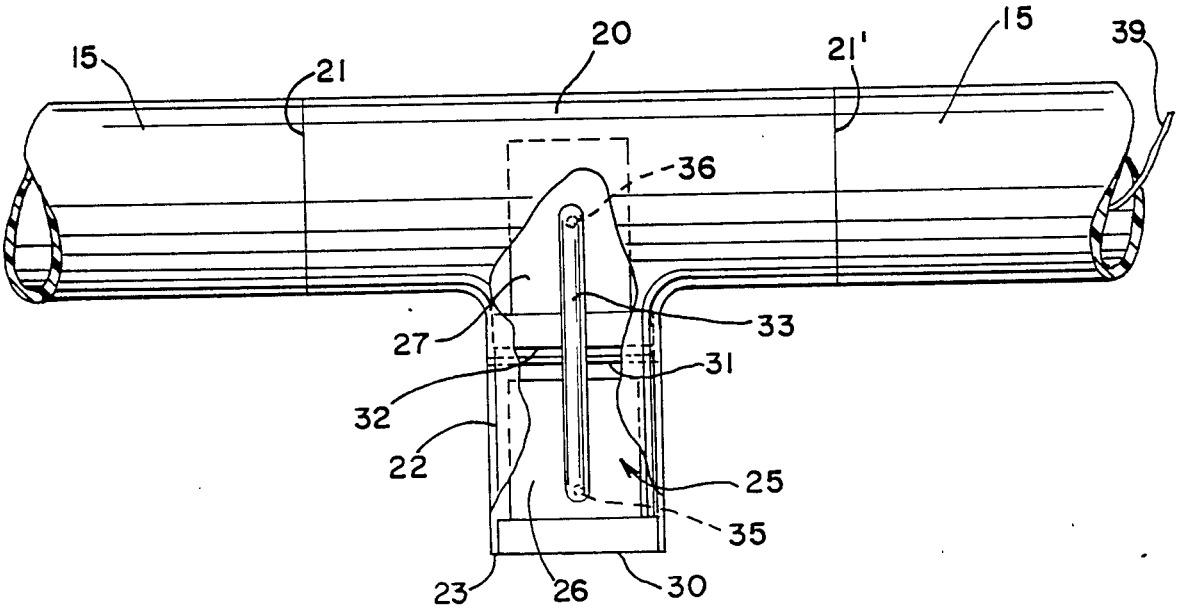

The foregoing and other objections and advantages of the present invention will be apparent to those skilled in the art from the following detailed description and claims when read in conjunction with the accompanying drawing wherein:

FIG. 1. is a schematic side elevational view showing apparatus of the present invention enclosing the below-the-water-line hull of a boat;

FIG. 2. is a schematic side elevational view of the apparatus of FIG. 1 in a semi-submerged position;

FIG. 3 is a schematic top plain view partially in the vertical section of the apparatus of FIG. 1; and FIG. 4. is a schematic fragmentaly end elevational view of the apparatus of FIG. 1.

The objects of the present invention are achieved by providing an apparatus which comprises in a preferred embodiment a semi-submergable planar rigid framework having a front or bow section, spaced side sections and a rear or stern section formed of rigid tubular sections, such as a water impervious rigid plastic tubing, sealably interconnected by rigid tubular elbow sections adapted to form a continuous enclosure around the circumference of at least the submerged portion of the hull of a boat or the like floatable body which is to be protectively enclosed. A water impervious continuous depending curtain or envelope is secured to the framework and defines a space having greater dimensions than the submerged or below-the-water-line dimensions of a boat hull.

The interior of the bow section of the framework is provided with flotation material which maintains the bow section buoyant on the surface of the water whenever the apparatus is disposed in an operative position in a body of water. For example, the interior of the tubular bow section is provided with a water impervious plastic foam material which is resistant to water or the foam material can be retained within the tubular bow section between sealing diaphrams mounted adjacent each end thereof which sealably encloses floatation material within the interior of the bow section. The hollow tubular side sections and tubular stern section have their interior in fluid flow communication and are adapted to have water pumped into and out of the interior thereof.

The stern section and side sections of the apparatus have operatively associated therewith pump means which in one mode is adapted to pump water into the interior of the tubular stern section and side sections of the framework to effect pivotally moving the stern section and side sections as a unit downwardly below the surface of the water while the bow section remains buoyant on the surface of the water so that the stern section of the apparatus is completely submergable to a depth greater than the draft of the boat to be enclosed within the framework with the side sections being substantially submergable except from the extreme forward ends thereof. The pump means is also adapted to remove the water from the interior of the side sections and stern section to cause the side and stern sections to rise and float on the surface of the body of water so as to enclose within the framework and envelope the below-the-water-line hull of a boat which has been moved over the submerged stern section and between the side sections.

In the preferred embodiment of the semi-submergable apparatus for enclosing the submerged portion of a boat hull 10 a rigid planar framework 11 is formed of rigid water imprevious tubular sections preferably made from a synethetic plastic material, such as polyvinylchloride or the like, with the tubular sections interconnected to provide a generally rectangular frame having a front end or bow section 12, spaced side section 13, 14 and a rear end or stern section 15 joined by elbow sections 16. The framework 11 should have a width and length greater than the dimensions of the boat hull at the water line, including any motor extending from the stern of the boat. The rigid tubular sections forming the framework 11 preferably have a diamater of about 4 inches where the framework 11 is about 8 feet wide and about 20 feet long.

The framework 11 is provided with a continuous depending flexible water imprevious curtain or envelope 17 secured to the framework along the entire circumference. The envelope 17 is preferably secured to the framework 11 by forming a small overlap or hem along the upper edge thereof through which a drawstring is placed and tied around the upper edge of the framework 11, thereby allowing the envelope 17 to be readily attached and removed with a minimal amount of effort. The envelope defines a space having greater dimensions than the submerged or below-the-water-line dimensions of the boat hull to be enclosed. The envelope 17 is preferably made of thin water resistant flexible plastic sheet material, such as polyethylene plastic or the like. When adapted for enclosing the hull of runabout motorboats or the like, the envelope 17 can, if desired be generally tapered inwardly and have a depth about of 3 feet.

The tubular bow section 12 of the framework 11 is preferably filled with a foamed plastic or the like floatation material 18, such as styrafoam or the like, which is imprevious to water. Optionally, the interior of the bow section can be sealably separated from the interior of the adjoining elbow sections 16 and side sections 13, 14. A sufficient amount of floatation material 18 which can be in the form of foam blocks inserted into the interior of the bow section 12 is provided within the tubular bow section 12 to maintain the bow section 12 at all times buoyant and floating on the surface of the body of water during the operation of the apparatus. The tubular side sections 13, 14 and stern section 15 are maintained in fluid flow communications and normally are substantially filled with air so as to keep the framework 11 floating on the surface of the body of water with the boat hull enclosed within the envelope 17 and framework 11. The envelope 17 is adapted to form a water impervious barrier between the boat hull 10 and the surrounding body of water so that a relatively small volume of water 19 remains within the envelope 17 and in contact with the submerged surface of the boat hull 10.

In the preferred embodiment the stern section 15 of the framework 11 is provided with a rigid tubular T-section 20 mounted preferably mid-way between the ends of the stern section 15 with the diametrically opposite ends 21, 21' of the T-section sealably connected with the stern section 15 and having the depending section 22 with its open lower end 23 mounted so as to extend downwardly from the plain of the framework 11, whereby the open end 23 of the T-section 20 extends into the body of water when the framework 11 is operatively floating on the surface of the body of water. The T-section 20 serves as the housing for pump means 25 which preferably comprises first pump 26 mounted in the lower end 22 of the T-section 20 for pumping water into the stern section 15 and side sections 13, 14 to replace the air therein which is vented through air holes 19, 19' when it is desired to submerge the stern section 15 and side sections 13, 14. A second pump 27 is provided in the T-section 20 for withdrawing water from the stern section 15 and side sections 13, 14, with air entering through the air passages 19, 19', when it is desired to refloat the stern section 15 and side sections 13, 14 after moving a boat across the submerged stern section 15 and within the area defined by the framework 11 and envelope 17.

In the preferred embodiment, as best shown in FIG. 4, the first pump 26 is mounted in the lower end of the depending section 22 of the tubular T-section 20 with the water ports 30 of the pump 26 disposed adjacent the submerged lower open end 23 of the T-section 20. A sealing plug or diaphram 31 is mounted within the lower end of the T-section 20 above the upper end of the first pump 26 so that the interior of the stern section 15 and side sections 13, 14 are sealably closed against the inflow of water except through the said pump means 25.

The second pump 27 is mounted within the tubular T-section 20 with the water ports 32 thereof disposed in the depending section 22 directly above the sealing diaphram 31. The ports 32 thereof are in fluid flow communication with the interior of the stern section 15. A length of rigid plastic pipe or tubing 33, such as a ¾ inch rigid polyvinylchloride piping, sealably connects the port 35 of the first pump 26 with the port 36 of the second pump 27 through which all incoming and outgoing water is conveyed. By having all the water pass through both pumps the system is more effectively freed of accumulations of debris. A siphon hole 38 is provided adjacent the upper end of the tubing 33 which breaks the siphoning action in the tubing 33 when power to the pumps is turned off.

The first and second pumps 26, 27 which are suitable for pumping water into and out of a framework 11 having dimensions of about 8 feet in width and 20 feet in length and formed of rigid tubular polyvinylchloride sections 4 inches in diameter are preferably electric direct current submergable- type pumps having a capacity of about 500 gallons per hour. The pumps can be operated by electric motors using 12 volt direct current and drawing 1.5 amps. The electric power for the pump is supplied preferably from a boat's electrical system or, if desired, from a direct current voltage convertor and a switch box mounted on a boat dock area. The electric line 39 extending through the interior of the tubular sections forming the framework 11 carries the electric power to the pumps.

The apparatus of the present invention can be secured to a boat dock by pivotally attaching to the bow section 12 of the framework 11 two spaced rigid arms or by attaching mooring lines from the foreward corners of the framework 11 to suitable cleats or the like on a boat dock or buoys so as to hold the apparatus securely in operative position. Additional lines can be secured to the rear corners of the framework 11 when the boat 10 is moored and enclosed within the framework 11 to prevent undesirable contact between the framework 11 and the boat hull 10 and a boat dook due to wind or currents.

In using the apparatus of the present invention to treat the below-the-water line hull surface of a boat hull 10 enclosed within the framework 11 and envelope 17, an effective amount of an anti-fouling chemical or other chemical is dissolved in the water retained within the envelope 17 and allowing the chemical to remain in contact with the boat hull 10 for a period required to remove marine growth from the surface of the boat hull 10. If desired, the boat hull can remain enclosed within the envelope 17 while the boat is not in use. When it is desired to remove the boat from within the framework 11 and envelope 17, the pump 27 is activated to pump water into the stern section 15 and side sections 13, 14 and force the air to exit through air passages 19, 19' which are formed in the upper surface of the forward elbow sections 16 sealably connected to the opposite ends of the bow section 12. As the stern section 15 and side sections 13, 14 fill with water, and the stern section 15 and side sections 13, 14 are moved pivotally downwardly as a unit about the floating bow section 12 until the stern section 15 is submerged in the body of water to a depth which permits the boat hull 10 to be moved rearwardly over the submerged stern section 15 and clear of the framework 11 and envelope 17. The framework 11 can be left in the semi-submerged position until the boat again enters the space defined by the apparatus, at which time the pump 26 can be activated to remove water from the framework 11 as air enters through the air passages 19, 19', allowing the framework 11 to refloat and enclose the submerged surface of the boat hull 10 within the envelope 17.

It is contemplated that the bow section 12 of the framework 11 need not necessarily be formed as a straight tubular section but can be formed of a short straight center section with a short straight lateral section extending angularly rearwardly from each end of the center section.

While it is preferred to have the pump means 25 mounted on the framework, and preferably on the stern section 15 of the framework 11, for filling and removing water from the rigid tubular stern section 15 and side sections 13, 14, it is contemplated that the pump means 25 can be mounted on the dock area or other shore facility with the pump means sealably connected to a side section 13, 14 or stern section 15 by flexible tubing extending from the pump means mounted on the dock.

I claim:

1. A selectively semi-submergible apparatus for enclosing the submerged body portion of a boat hull while the body remains floating in water comprising:

(1) a semi-submergible planar rigid framework formed of sealably interconnected water impervious rigid tubular bow, side and stern sections, said framework having a length and width greater than the length and width of a submerged body portion to be enclosed therein, (2) a depending water impervious continuous envelope secured to said framework with said envelope defining a space having greater dimensions than the submerged body portion, (3) said tubular bow section having between the ends thereof floatation material which prevents water filling the interior of said bow section and maintains said bow section buoyant while said framework remains in the water, (4) said tubular side sections and stern section having the interior thereof in fluid flow communication, (5) pump means in fluid flow communication with the interior of said tubular side sections and stern section, (6) said pump means being adapted for pumping water into the interior of said tubular side and stern sections to effect pivotally moving said side and stern sections relative to said bow sections as a unit downwardly to completely submerge said stern section below the surface of said water to a depth greater than the draft of said submerged body portion while said bow section remains buoyant on the surface of the water whereby the submerged body portion can be freely moved across the submerged stern section and within the perimeter of said framework, and (7) said pump means being further adapted to remove water from the interior of said side sections and stern section to effect floating siad side and stern sections and enclosing the submerged body portion within said framework and envelope.

2. An apparatus as in claim 1, wherein said pump means is supported by said stern section and is adapted to be in fluid flow communication with a body of water when said framework is operatively disposed in said body of water.

3. An apparatus as in claim 2, wherein said pump means comprises a rigid tubular pump housing section mounted between the ends of said stern section and said pump housing section having a depending end supporting a pump therein adapted to be in fluid flow communication with said body of water when said apparatus is operatively disposed in said body of water.

4. An apparatus as in claim 1, wherein said pump means comprising a first pump adapted for pumping water into said side and stern sections and a second pump adapted to remove said water from said side and stern sections.

5. An apparatus as in claim 4 wherein said first pump and said second pump are electrically actuated.

6. An apparatus as in claim 1, wherein said framework has a generally rectangular configuration with said bow and stern sections having a length greater than the width of said submerged body portion and said side sections having a length greater than the overall length of said submerged body portion.

7. An apparatus as in claim 1, wherein said framework is formed of water resistant rigid plastic tubing.

8. An apparatus as in claim 7, wherein said plastic tubing is formed of rigid polyvinylcholride.

9. An apparatus for enclosing a boat hull as in claim 1, wherein said envelope is formed of water resistant flexible sheet material.

10. An apparatus as in claim 9, wherein said flexible sheet material is formed of water resistant synthetic plastic.

11. A selectively semi-submergible apparatus for enclosing the submerged body portion of a boat hull while the body remains floating in water comprising:

(1) a semi-submergible planar rigid framework formed of sealably interconnected water impervious rigid tubular bow, side and stern sections, said framework having a length and width greater than the length and width of a submerged body portion to be enclosed therein, (2) a depending water impervious continuous envelope secured to said framework with said envelope defining a space having greater dimensions that the submerged body portion, (3) said tubular bow section having between the ends thereof floatation material which prevents water filling the interior of said bow section and maintains said bow section buoyant while said framework remains in the water, (4) said tubular side sections and stern section having the interior thereof in fluid flow communication, (5) pump means in fluide flow communication with the interior of said tubular side sections and stern section, (6) said pump means being adapted for pumping water into the interior of said tubular side and stern sections to effect pivotally moving said side and stern sections as a unit downwardly to completely submerge said stern section below the surface of said water to a depth greater than the draft of said submerged body portion while said bow section remains buoyant on the surface of the water whereby the submerged body portion can be freely moved across the submerged stern section and within the perimeter of said framework, and (7) said pump means being further adapted to remove water from the interior of said side sections and stern section to effect floating said side and stern sections and enclosing the submerged body portion within said framework and envelope, said pump housing section comprising a rigid tubular T-section having diametrically opposite end sections sealably connected with the said stern section midway between the ends thereof and a depending end of said T-section adapted to be submerged in said body of water when the framework is opertively disposed in said body of water.

* * * * *